US011026460B2

(12) United States Patent
Taylor

(10) Patent No.: US 11,026,460 B2
(45) Date of Patent: Jun. 8, 2021

(54) HAIR FILLER DEVICE

(71) Applicant: Stormy McCowen Taylor, Round Rock, TX (US)

(72) Inventor: Stormy McCowen Taylor, Round Rock, TX (US)

( * ) Notice: Subject to any disclaimer, the term of this patent is extended or adjusted under 35 U.S.C. 154(b) by 414 days.

(21) Appl. No.: 15/911,812

(22) Filed: Mar. 5, 2018

(65) Prior Publication Data

US 2018/0255856 A1 Sep. 13, 2018

Related U.S. Application Data

(60) Provisional application No. 62/466,458, filed on Mar. 3, 2017.

(51) Int. Cl.
*A41G 3/00* (2006.01)
*A41G 5/00* (2006.01)

(52) U.S. Cl.
CPC ..... *A41G 5/0073* (2013.01); *A41G 5/0046* (2013.01)

(58) Field of Classification Search
CPC ..... A41G 3/00; A41G 3/0008; A41G 3/0033; A41G 3/0066; A41G 5/00; A41G 5/0006; A41G 5/0013; A41G 5/0026; A41G 5/004; A41G 5/0053; A41G 5/0073; A41G 5/0046
See application file for complete search history.

(56) References Cited

U.S. PATENT DOCUMENTS

| | | | | |
|---|---|---|---|---|
| 9,010,341 | B1 | 4/2015 | Lee | |
| 2005/0194015 | A1 | 9/2005 | Watts | |
| 2007/0157941 | A1* | 7/2007 | Awad | A41G 5/0026 132/53 |
| 2008/0257369 | A1 | 10/2008 | Poole | |
| 2011/0036368 | A1 | 2/2011 | Park | |
| 2012/0167909 | A1* | 7/2012 | Stewart | A45D 8/30 132/210 |
| 2013/0042881 | A1* | 2/2013 | Mutchler | A41G 5/0026 132/201 |
| 2013/0167855 | A1 | 7/2013 | Kupitz | |
| 2015/0223538 | A1 | 8/2015 | Yanniello | |
| 2017/0258162 | A1* | 9/2017 | Romm | A41G 5/006 |

FOREIGN PATENT DOCUMENTS

CA 2585699 * 5/2005

* cited by examiner

*Primary Examiner* — Rachel R Steitz
(74) *Attorney, Agent, or Firm* — Maier & Maier, PLLC

(57) ABSTRACT

A fair filler device may be provided. A hair filler device may include a backing having a base and a flap portion. A plurality of hair strands may project from the base and the flap. Hair filler device may further include at least two clips disposed on the base for securing the hair filler device to a desired material, such as a wearer's existing hair.

16 Claims, 9 Drawing Sheets

HAIR FILLER DEVICE

CROSS-REFERENCE TO RELATED APPLICATIONS

This application claims priority from U.S. Provisional Patent Application No. 62/466,458, filed on Mar. 3, 2017, entitled "HAIR FILLER DEVICE," the entire contents of which are hereby incorporated by reference.

BACKGROUND

Hair extensions and other hair attachments have existed in the marketplace for some time. Hair extensions and attachments offer stylistic effects or hide unwanted thinning and/or balding. However, conventional hair extensions and hair filler attachments are generally limited to a specific placement on a user's head and even to a specific direction. The limitations on positioning and direction limit the comfort, security and natural appearance of such attachments. It may therefore be desired to have a hair attachment that can be secured to any area of a user's head and adjusted at any angle, while also offering a blendable, natural appearance.

SUMMARY

A hair filler device may be provided. A hair filler device may include a backing having a base and a flap portion. A plurality of hair strands may project from the base and the flap. A hair filler device may further include at least two clips disposed on the base for securing the hair filler device to a desired material, such as a wearer's existing hair.

BRIEF DESCRIPTION OF THE FIGURES

Advantages of embodiments of the present invention will be apparent from the following detailed description of the exemplary embodiments. The following detailed description should be considered in conjunction with the accompanying figures in which.

Exemplary

DETAILED DESCRIPTION

Figure 1:
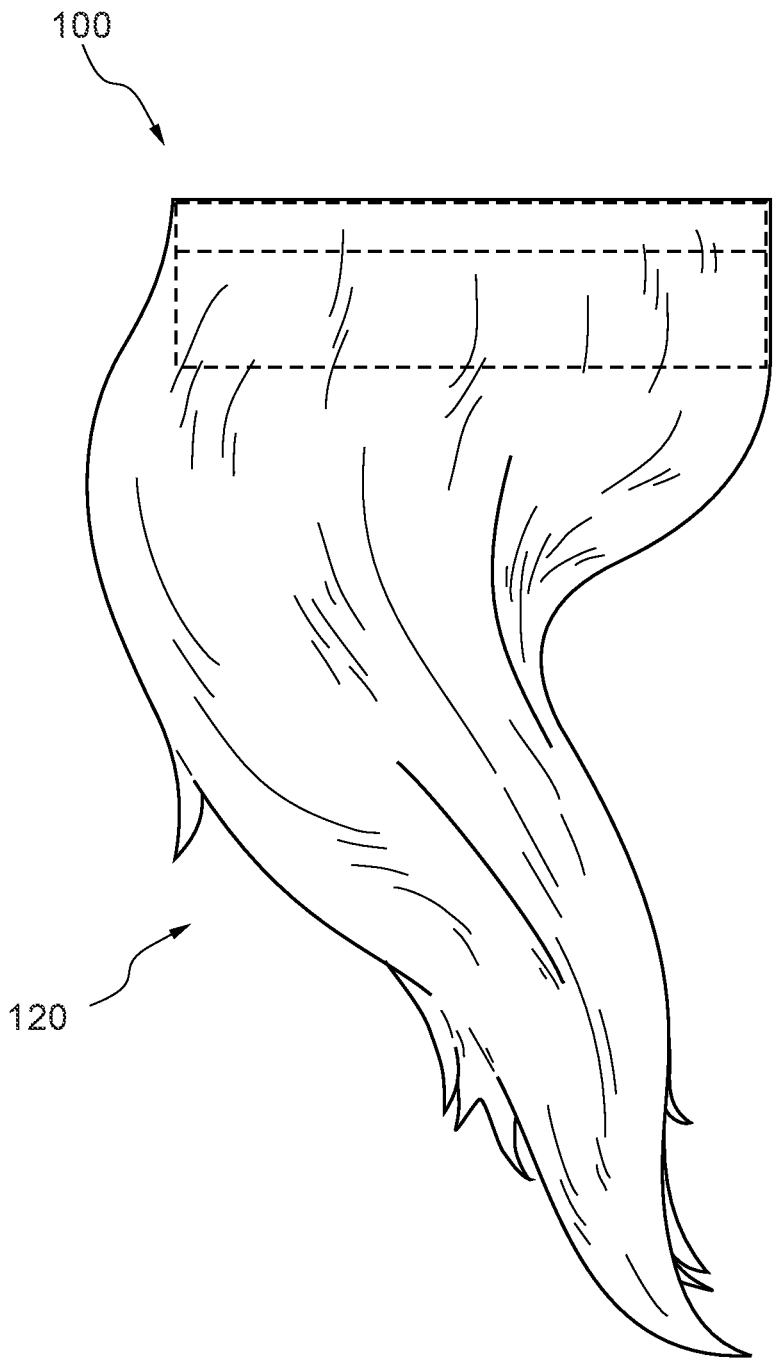
FIG. 1 shows a hair filler device;
Exemplary
Figure 2:
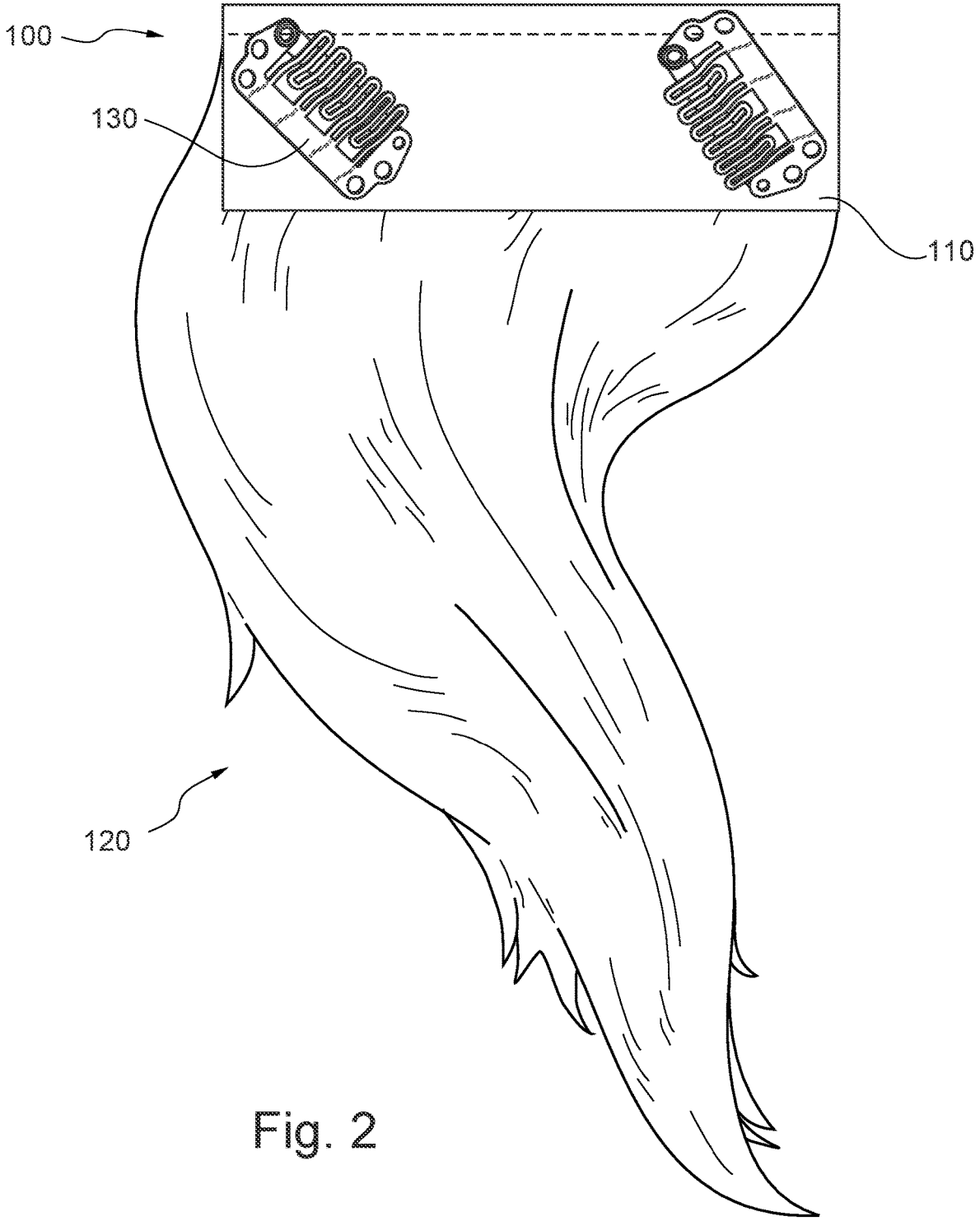
FIG. 2 shows a hair filler device;
Exemplary
Figure 3:
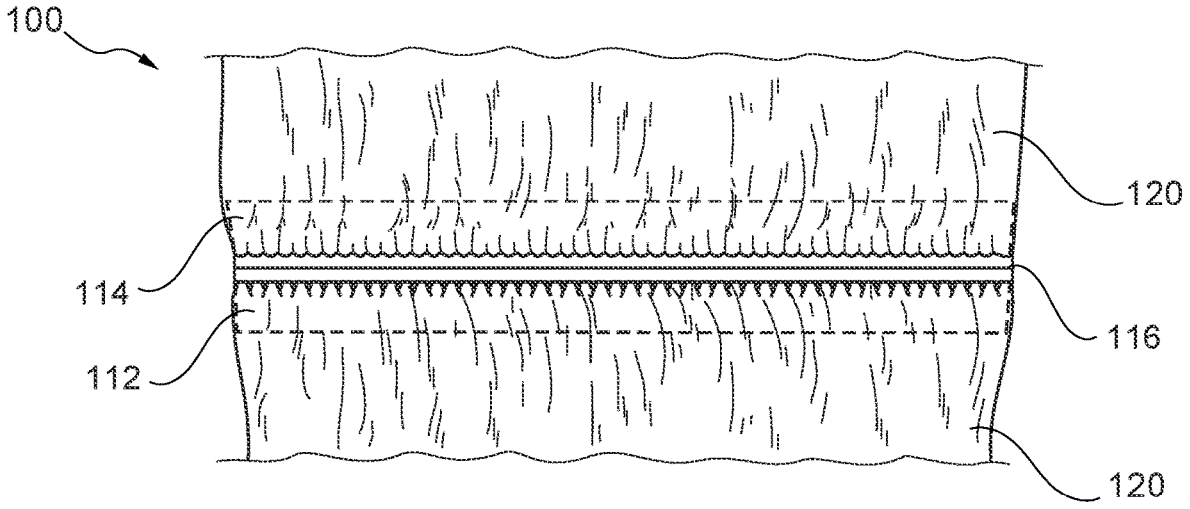
FIG. 3 shows a hair filler device;
Exemplary
Figure 4:
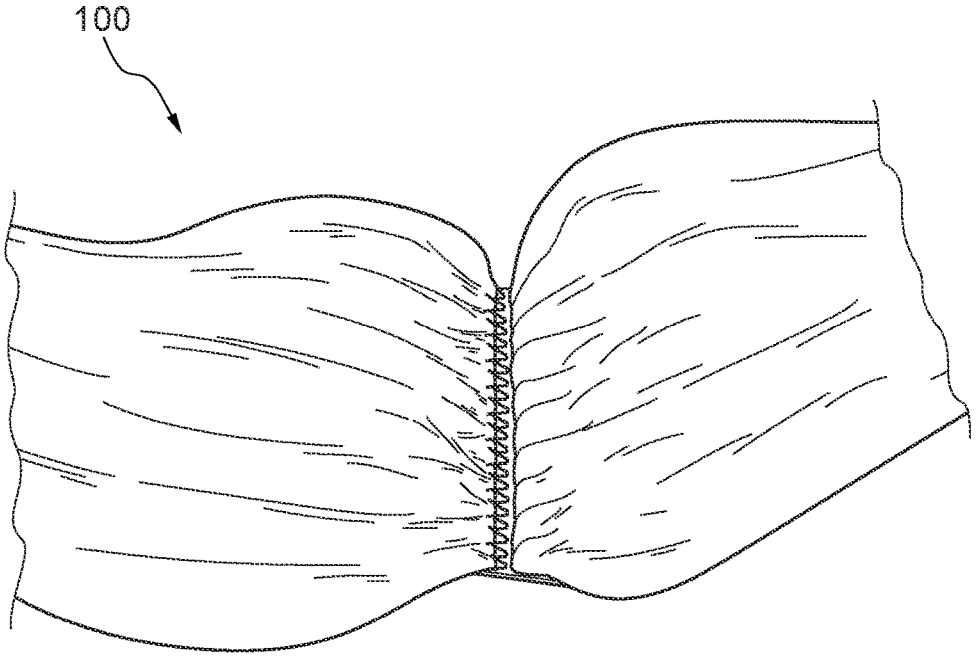
FIG. 4 shows a hair filler device;
Exemplary
Figure 5:
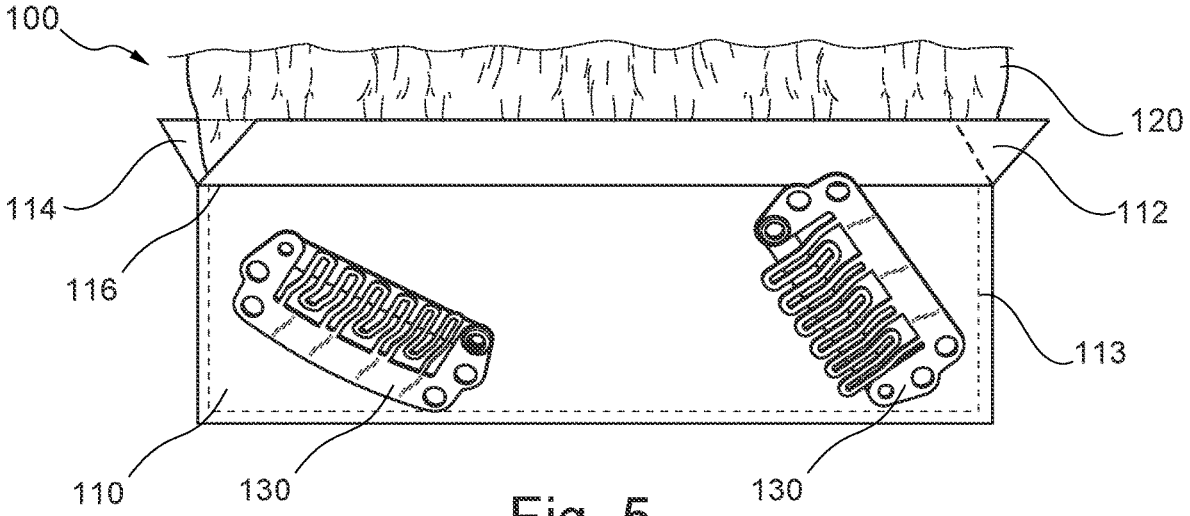
FIG. 5 shows a hair filler device;
Exemplary
Figure 6:
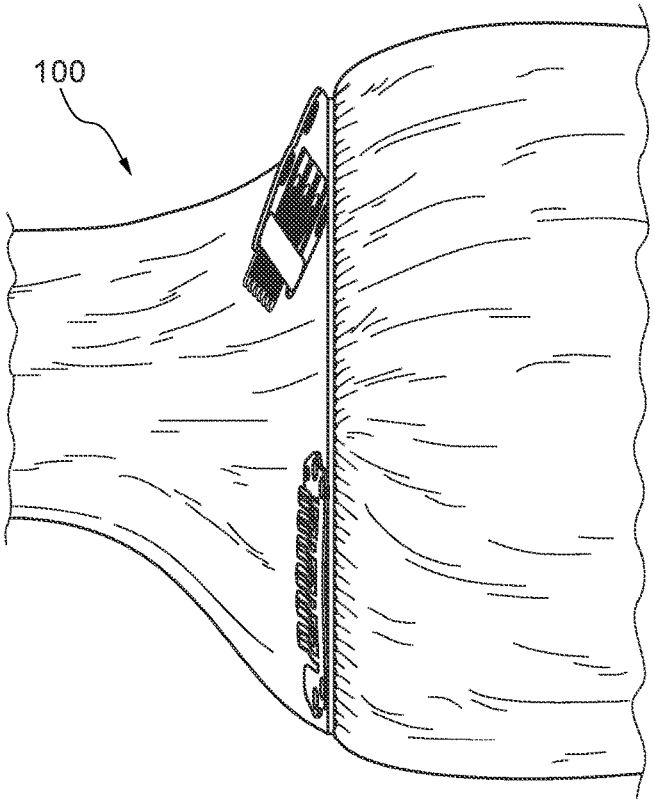
FIG. 6 shows a hair filler device;
Exemplary
Figure 7:
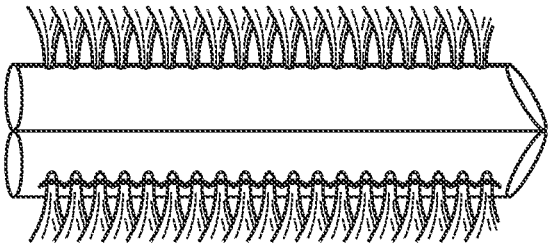
FIG. 7 shows a hair filler device;
Exemplary
Figure 8:
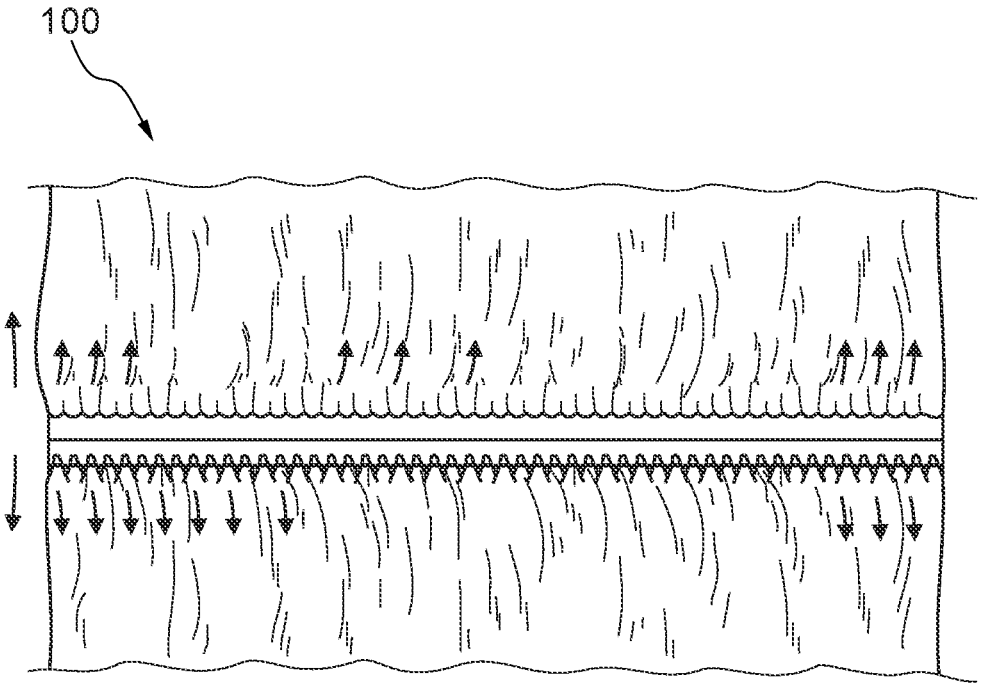
FIG. 8 shows a hair filler device;
Exemplary
Figure 9:
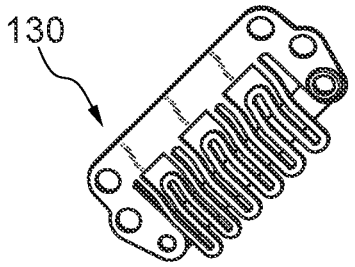
FIG. 9 shows a snap clip;
Exemplary
Figure 10:
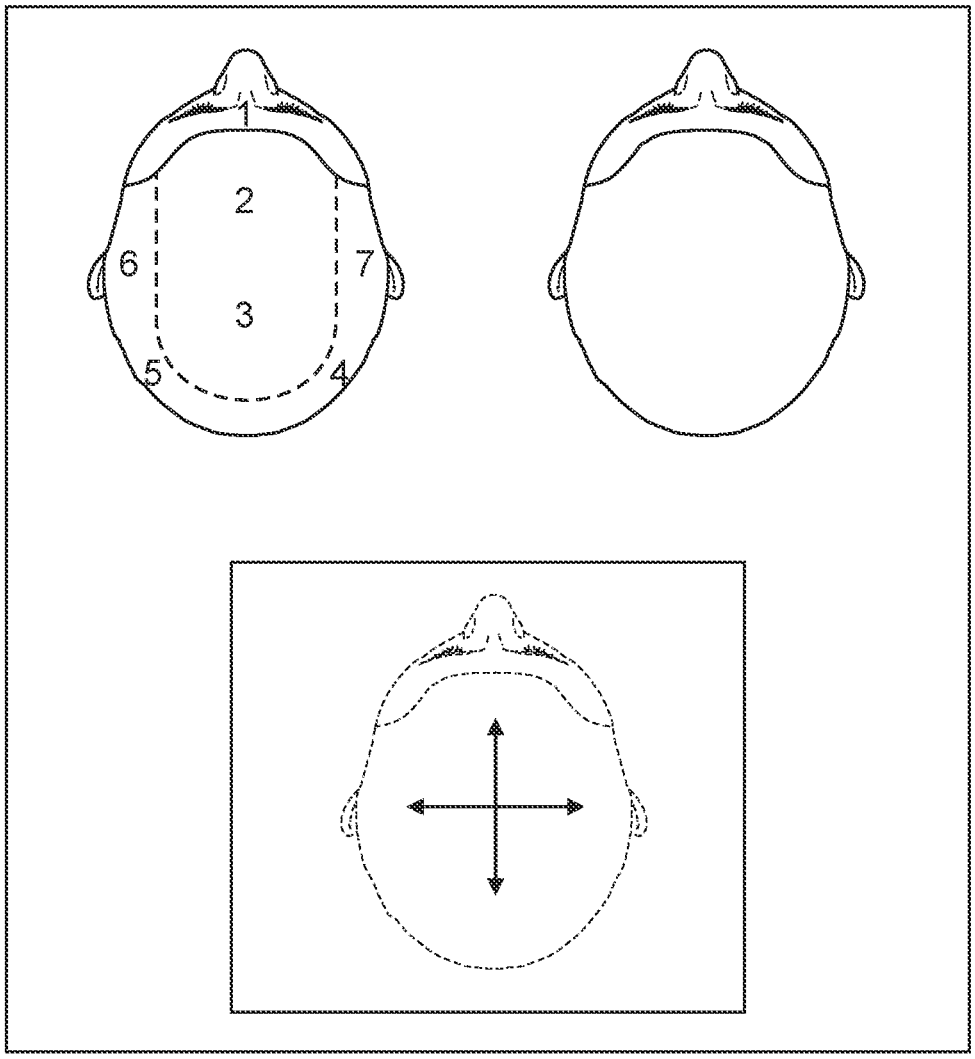
FIG. 10 shows a hair filler device orientation chart;
Exemplary

Aspects of the invention are disclosed in the following description and related drawings directed to specific embodiments of the invention. Alternate embodiments may be devised without departing from the spirit or the scope of the invention. Additionally, well-known elements of exemplary embodiments of the invention will not be described in detail or will be omitted so as not to obscure the relevant details of the invention. Further, to facilitate an understanding of the description discussion of several terms used herein follows.

As used herein, the word "exemplary" means "serving as an example, instance or illustration." The embodiments described herein are not limiting, but rather are exemplary only. It should be understood that the described embodiment are not necessarily to be construed as preferred or advantageous over other embodiments. Moreover, the terms "embodiments of the invention", "embodiments" or "invention" do not require that all embodiments of the invention include the discussed feature, advantage or mode of operation.

According to at least one exemplary embodiment, and as shown in FIG. 1-15, a hair filler device 100 may be provided. Hair filler device 100 may conform to the shape and size of a wearer's head and may provide a natural, discreet appearance. Hair filler device 100 may include a backing 110 with a plurality of hair strands 120 projecting therefrom. Hair strands 120 may include human hair or processed human hair. In some alternative embodiments, animal hair, or imitation hair, such as synthetic hair strands, may be used, as would be understood by a person having ordinary skill in the art. According to one exemplary embodiment, backing 110 may be made of a mesh material. In some exemplary embodiments, backing 110 may be a monofilament lace material, glass silk material, or other fabric as would be understood by a person having ordinary skill in the art. Backing 110 may optionally be transparent.

The plurality of hair strands 120 may be tied or otherwise affixed to backing 110, as would be understood by a person having ordinary skill in the art. According to an exemplary embodiment, and as shown in the Figures generally, backing 110 may be folded or otherwise constructed to provide a bottom edge or base 112 and a top flap 114. Top flap 114 may fold at least partially over base 112. The plurality of hair strands 120 may be affixed to base 112 and top flap 114, such that multiple layers of hair strands 120 are created.

According to at least one exemplary embodiment, hair strands 120 may be tied to backing 110. Hair strands 120 may be tied to backing 110 in a series of rows. Strands 120 may be tied to backing 110 with single knots, double knots, or other knots as would be understood by a person having ordinary skill in the art. In some embodiments, strands 120 may be tied to backing 110 using a combination or variety of knots. For example, each row of hair strands 120 may be tied using a particular knot. Single knots may be used to minimize the visibility of the knots and provide a more natural appearance. Double split knots may be used to control the direction and orientation of hair strands 120. Double split knots may further contribute to desired texture and depth for a natural appearance, as desired.

According to an exemplary embodiment, backing 110 may be cut to a desired size and shape, as would be understood by a person having ordinary skill in the art. An exemplary backing 110 may be rectangular. Backing 110 may be sewn around its perimeter. Backing 110 may be folded over itself at least once and sewn in a folded orientation. In an exemplary embodiment, backing 110 may be folded over itself twice. All edges of backing 110 may be sewn to prevent fraying and undesired loose material. Side edges may also be folded inward prior to sewing, resulting in a neat, folded seam 113 around the perimeter. After the second fold, an overhanging flap 114 may be folded back over the bottom edge portion or base 112 of the backing 110, forming a seam 116. In some exemplary embodiments, flap 114 may be approximately ⅛th of an inch.

Figure 11:
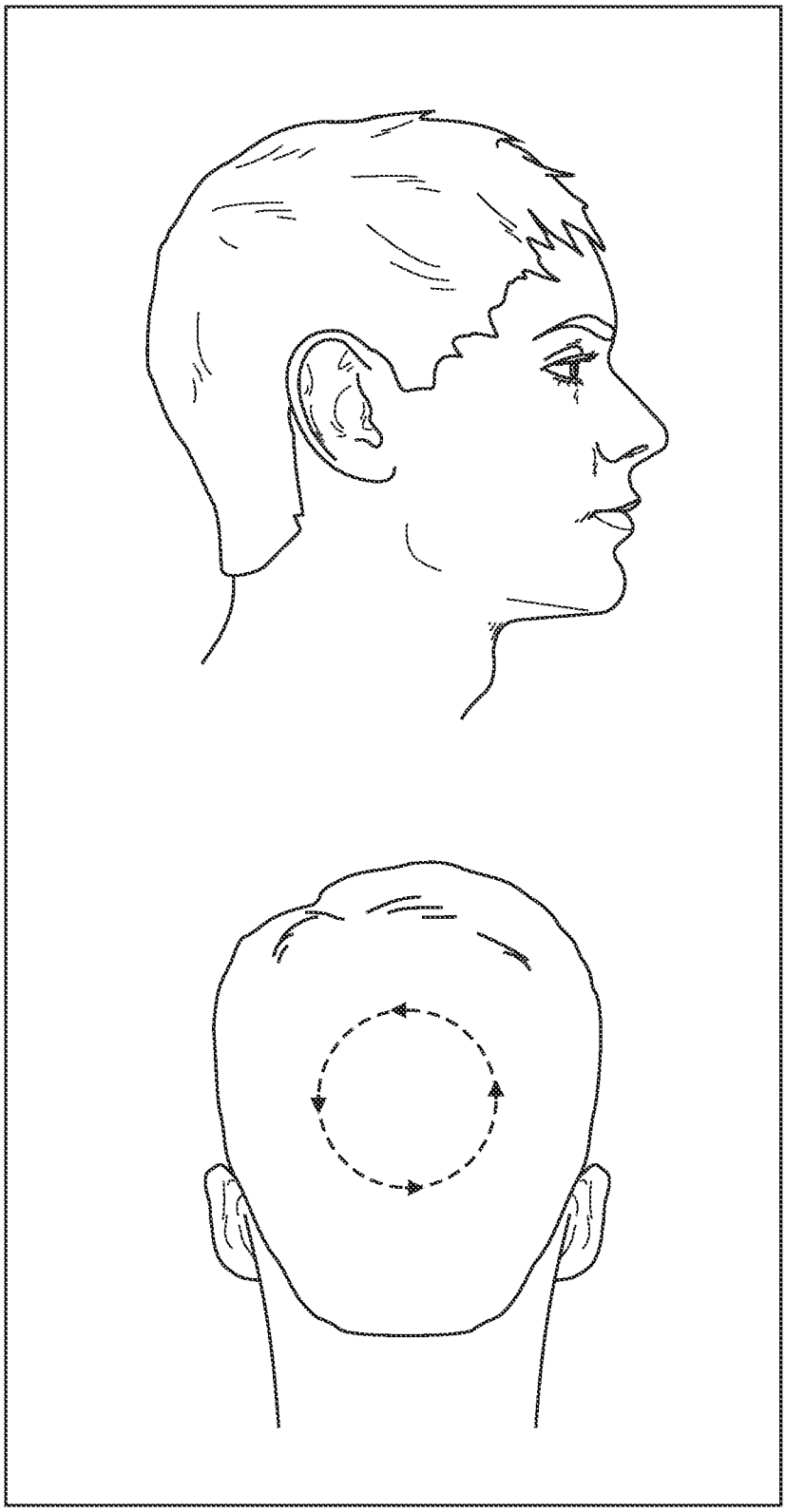
FIG. 11 shows a hair filler device orientation chart;
Exemplary
Figure 12:
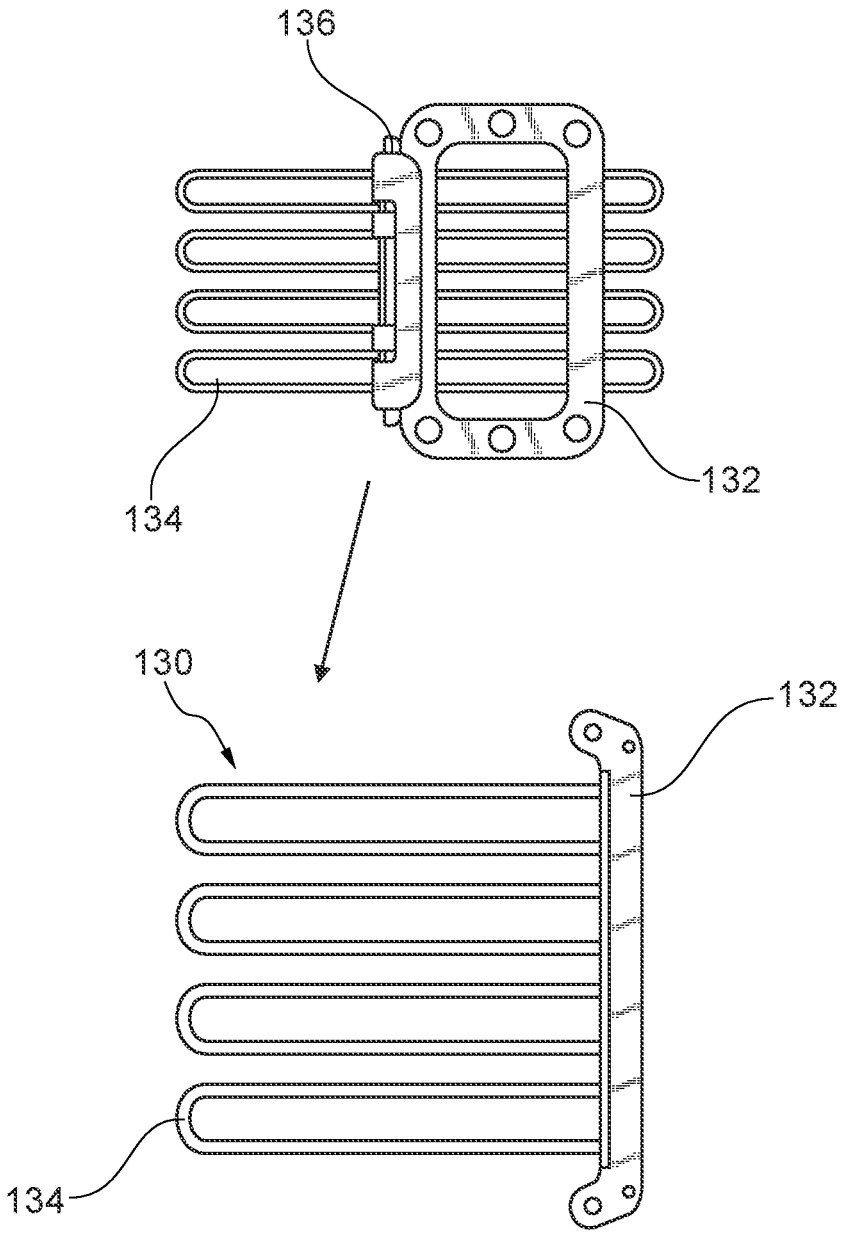
FIG. 12 shows a snap clip; and
Exemplary
Figure 13:
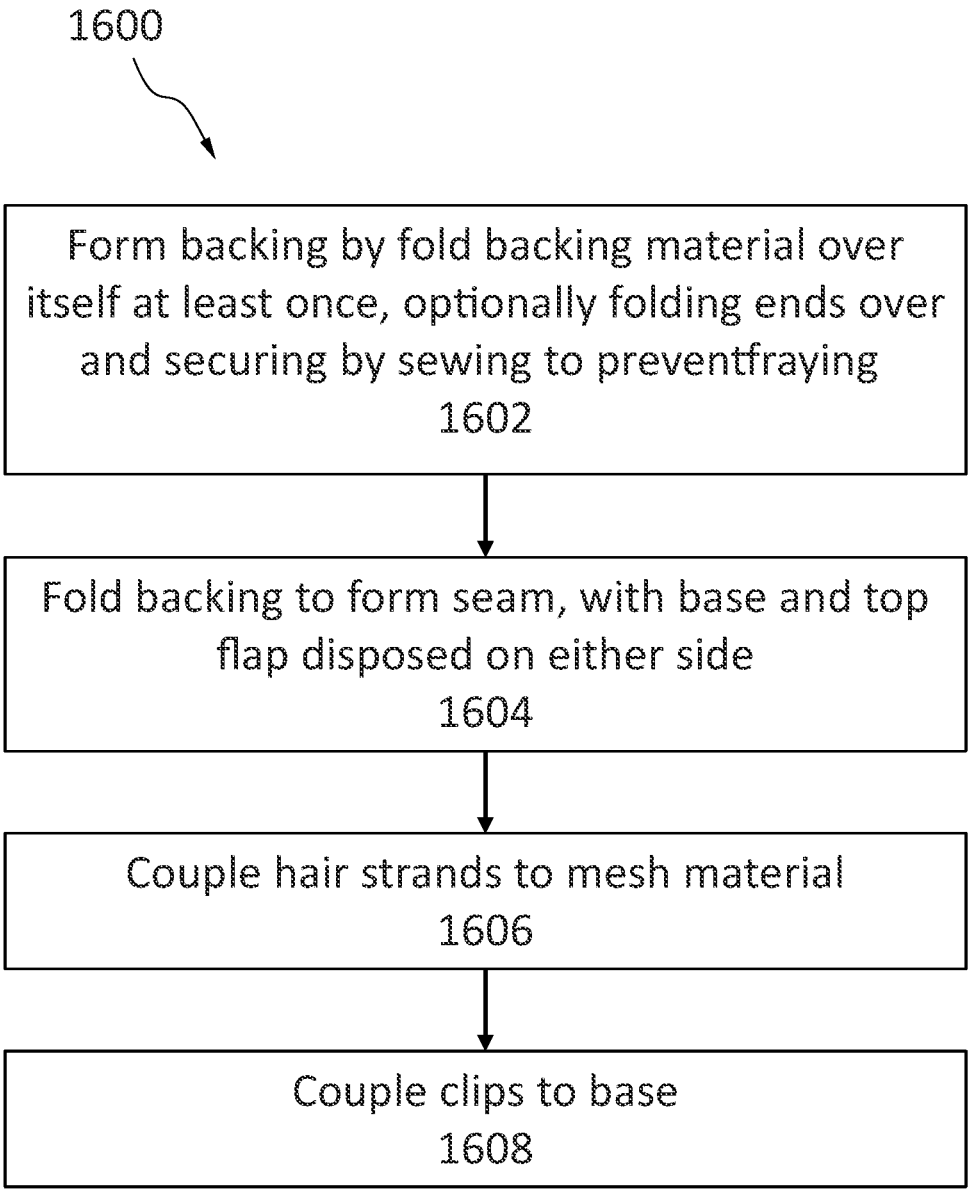
FIG. 13 shows a method of forming a hair filler device.

In an exemplary embodiment, a first row of hair strands 120 may be secured to flap 114 along seam 116 using single hair knotted. A second row below the first row may be double split knotted. Lastly, a third row below the second row may be single knotted. Any number of desired rows may be implemented, as would be understood by a person having ordinary skill in the art. According to some further exemplary embodiments, five rows of hair strands 120 may be provided on flap 114, as shown in FIG. 11. A single machine weft strip of hair 120 may be sewn to base 112 under or proximate the flap 114 on backing 110. The hair 120 sewn to base 112 may provide added thickness and volume. In some exemplary embodiments, additional rows of hair strands 120 may be provided on base 112.

An exemplary embodiment may further include clips 130, as shown in FIG. 11-15. Clips 130 may optionally be snap clips or hinged clips, as would be understood by a person having ordinary skill in the art. Clips 130 may include a bar 132 and comb component 134. Hinge clips 130 may include a bar 132 connected to a comb component 134 by a hinge 136. Hinge 136 may allow comb component 134 to open and close from bar 132. Hinge clips may allow the comb component to open and close from the bar by swinging backwards and forwards. The swinging nature of the hinge clip may allow for grabbing a greater amount of a user's hair or a varied amount of a user's hair. Hinge clips may be capable of locking in a closed orientation. In snap clip embodiments, there may be no hinge and instead, bar 132 may be flexible and may be snapped or bent, such that the bar locks against a comb component 134, locking the clip to a desired material disposed between the bar and the comb component, such as a wearer's existing hair. An exemplary hair filler device may include two clips 130. To allow for orienting a hair filler device in a variety of orientations on a wearer's head, clips 130 may be disposed such that a first clip and second clip open toward opposing corners of backing 110. Clips 130 may be affixed to backing 130 by sewing, rivets, adhesive, snaps, clips, hook and loop fasteners, or other comparable fasteners as would be understood by a person of ordinary skill in the art. Clips may optionally include a rubber coating on bar 132 or comb component 134 for additional grip. An exemplary clip may be approximately 1¼ inches wide by 1½ inches deep.

According to an exemplary embodiment, and as shown in FIG. 16, a supplemental hair attachment device may be formed according to method 1600. In a first step 1602, the backing may be formed by folding backing material, such as mesh, over itself at least once, optionally folding the ends over and securing the ends by sewing in order to prevent fraying. In a next step 1604, the backing may be folded in order to form a seam, with the base and the top flap disposed on either side of the seam. In a next step 1606, the hair strands may be coupled to the mesh material. In a next step 1608, the clips may be coupled to the base. Any other steps, such as the coupling of additional rows of hair strands to the mesh material (such as the mesh material of the base) may be introduced where desired.

The foregoing description and accompanying figures illustrate the principles, preferred embodiments and modes of operation of the invention. However, the invention should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A supplemental hair attachment device, comprising:

a rectangular backing, the backing comprising a base and a top flap, each of the base and the top flap being formed from mesh material and connected by an intermediate flexible portion, each of the top flap and the base having a first side and a second side, the backing configured to fold along the intermediate flexible portion such that the first side of the top flap extends at least partially over the first side of the base;

a plurality of hair strands coupled to and extending from the second side of the top flap and the second side of the base, each of the plurality of hair strands coupled to the mesh material by a knot connection; and a plurality of clips comprising a first clip and a second clip, each of the clips coupled to the first side of the base, each clip comprising a fixed comb component and a locking bar configured to lock against the comb component, wherein the first and second clips are disposed in opposing corners of the rectangular backing and wherein the first clip is angled toward the second clip and the second clip is angled toward the first clip.

2. The device of claim 1, wherein the backing is formed from at least one of monofilament lace or glass silk.

3. The device of claim 1, wherein the backing is transparent.

4. The device of claim 1, wherein the backing comprises multiple folded layers of material secured by sewing.

5. The device of claim 1, wherein the backing comprises a perimeter seam portion, said perimeter seam portion comprising one or more folded side edges extending contiguously around a perimeter of the backing, said one or more folded side edges secured in a folded position by sewing.

6. The device of claim 1, wherein each of the plurality of hair strands is coupled to the mesh material by a single knot connection.

7. The device of claim 1, wherein each of the plurality of hair strands is coupled to the mesh material by a double-split knot connection.

8. The device of claim 1, wherein a portion of the plurality of hair strands are coupled to the mesh material by single knot connections and a portion of the plurality of hair strands are coupled to the mesh material by double split knot connections.

9. The device of claim 8, wherein a first portion of the plurality of hair strands are coupled to the mesh material by single knot connections such that the first portion is disposed in a first row along the length of the intermediate flexible portion, wherein a second portion of the plurality of hair strands are coupled to the mesh material by double-split knot connections such that the second portion is disposed in a second row adjacent to and parallel to the first row, and wherein a third portion of the plurality of hair strands are coupled to the mesh material by single knot connections such that the third portion is disposed in a third row adjacent to and parallel to the second row.

10. The device of claim 1, wherein each of the plurality of clips is a snap clip and wherein the locking bar of each of the plurality of clips is flexible.

11. The device of claim 1, wherein each of the plurality of clips is a hinge clip, and wherein the locking bar of each of the plurality of clips is connected to the fixed comb component of the clip by a hinge disposed on one side of the locking bar and is further configured to lock in a closed orientation when adjacent to the fixed comb component of the clip.

12. The device of claim 11, wherein the fixed comb component comprises a plurality of tines oriented perpendicular to the hinge, and the locking bar component comprises a loop structure having a first end coupled to the hinge and a second end configured to be held against the plurality of tines when the locking bar is in a locked position.

13. The device of claim 1, wherein the plurality of clips consists of two clips, a first clip disposed in a first corner of the base and a second clip disposed in a second corner of the base, the first clip comprising a hinge and a locking bar configured to open towards the first corner and the second clip comprising a hinge and a locking bar configured to open towards the second corner.

14. The device of claim 1, wherein each of the plurality of clips further comprises a rubber grip coating.

15. The device of claim 1, wherein each of the plurality of hair strands is formed from at least one of human hair, animal hair, or synthetic hair.

16. The device of claim 1, further comprising a second plurality of hair strands coupled to and extending from the first side of the base on a side of the base opposite the intermediate flexible portion, each of the second plurality of hair strands coupled to the mesh material by a knot connection.

* * * * *